United States Patent [19]

Imamura et al.

[11] Patent Number: 4,720,709

[45] Date of Patent: Jan. 19, 1988

[54] COLOR DISPLAY SYSTEM UTILIZING A MATRIX ARRANGEMENT OF TRIADS

[75] Inventors: Shigeharu Imamura, Nara; Tadashi Kobayashi, Ayase, both of Japan

[73] Assignee: Matsushita Electric Industrial Co., Ltd., Japan

[21] Appl. No.: 570,680

[22] Filed: Jan. 13, 1984

[30] Foreign Application Priority Data

Jan. 13, 1983 [JP] Japan ..... 58-3464
Jan. 13, 1983 [JP] Japan ..... 58-3465
Jun. 16, 1983 [JP] Japan ..... 58-108750

[51] Int. Cl.[4] ..... G09G 3/00

[52] U.S. Cl. ..... 340/815.20; 340/700; 340/701; 340/800; 40/573; 362/294

[58] Field of Search ..... 340/700, 701, 703, 800, 340/815.2, 718; 40/573, 581, 605; 362/294; 358/240

[56] References Cited

U.S. PATENT DOCUMENTS

| | | | |
|---|---|---|---|
| 3,375,773 | 4/1968 | Wotoweic et al. | 362/294 |
| 4,113,361 | 9/1978 | Nakano | 340/800 |
| 4,286,263 | 9/1981 | Lindberg | 340/718 |
| 4,367,464 | 1/1983 | Kurahashi et al. | 340/703 |
| 4,368,485 | 1/1983 | Midland | 340/701 |
| 4,384,279 | 5/1983 | Fujita | 340/700 |
| 4,438,580 | 3/1984 | Yamaji et al. | 340/700 |
| 4,449,148 | 5/1984 | Inohara et al. | 358/230 |
| 4,506,261 | 3/1985 | Lawter | 340/718 |
| 4,571,614 | 2/1986 | Iyehara et al. | 358/230 |
| 4,578,672 | 3/1986 | Oota et al. | 340/784 |

*Primary Examiner*—Gerald L. Brigance
*Assistant Examiner*—Jeffery A. Brier
*Attorney, Agent, or Firm*—Lowe, Price, LeBlanc, Becker & Shur

[57] ABSTRACT

A color display system for use in stadiums, arenas or streets has a matrix of three-primary triads of light-emitting elements controlled by electric signals for displaying images, characters, and/or other patterns in colors. The color display system comprises display units arrayed in horizontal rows and vertical columns and each having simplified electric connector means for external electric connection and means for effectively cooling the light-emitting elements which are packed at high density. Each of the display units has two horizontal rows of light-emitting elements mounted on a front panel of a display unit body, a control circuit housed in the body, and electric connector means mounted on a rear panel of the body. The display units are located closely in each horizontal row and spaced at intervals in each vertical column. A ventilator is disposed behind the display units for cooling the light-emitting elements. Various support arrangements are provided for stably supporting the display units which may have an increased depth.

14 Claims, 19 Drawing Figures

COLOR DISPLAY SYSTEM UTILIZING A MATRIX ARRANGEMENT OF TRIADS

BACKGROUND OF THE INVENTION

The present invention relates to a color display system to be installed in stadiums, arenas, or streets for displaying images, characters and/or other patterns in colors by controlling a matrix of triads of light-emitting elements capable of emitting three primary colors with electric signals.

Known electric display systems installed in stadiums, arenas, streets or other public facilities and spaces comprise a matrix of incandescent lamps controlled by electric signals for displaying characters, images, and/or other patterns in monochromatic tones. As long as only characters are to be displayed, monochromatic display systems are usually satisfactory. However, monochromatic display systems have proven unattractive if images or graphic patterns are to be displayed thereon. To cope with this problem, there has been developed in the recent past a system composed of a matrix of three-primary triads of light-emitting elements for displaying colored images. Where only the colors of the light-emitting elements are to be displayed, the color display system is subjected to no technical difficulty since the density of light-emitting elements per unit area is not required to be increased. Where any images are to be displayed in natural colors by mixing the three primary colors, however, the light-emitting elements have to be packed at a much higher density, resulting in a variety of technical difficulties to be solved. More specifically, a color display system capable of displaying images and graphic patterns in various colors by mixing the three primary colors requires that about thirty to ninety thousand light-emitting elements be packed at an increased density such as at a pitch or inter-element interval of about 22 to 45 mm. Such a color display system is disadvantageous in that it is quite large in scale, is highly difficult to install, and a large amount of heat will be generated by the matrix of light-emitting elements.

One electric color display system which has heretofore been developed comprises a number of bar-shaped parallel display units each composed of an array of light-emitting elements. Two adjacent display units serve as one set of triads of light-emitting elements of three primary colors. Therefore, two separate trains of electric signals have to be applied to the display units in each triad set, thus requiring a complex wiring arrangement. Since there are required at least as many lead wires as there are light-emitting elements, a large number of cables are necessary for connection of the light-emitting elements to a control circuit disposed behind the display units. It is a tedious and time-consuming task to lay and connect those cables. The cables need a large installation space behind the display units and result in a substantial increase in the cost. In addition, only a limited space is available for the installation of a ventilator for cooling the light-emitting elements.

Another prior color display unit is in the form of a rectangular parallelopied supporting on its face a matrix of light-emitting elements. Such a display unit, particularly those light-emitting elements close to the center thereof, cannot sufficiently be cooled for heat dissipation by a ventilator positioned behind the display unit.

SUMMARY OF THE INVENTION

It is an object of the present invention to provide a color display system which will eliminate the foregoing conventional drawbacks.

Another object of the present invention is to provide a color display system composed of a plurality of display units which are appropriately unitized for easy installation and wiring.

Still another object of the present invention is to provide a color display system having simplified electric connector means for external connection.

A still further object of the present invention is to provide a color display system having means for effectively cooling a multiplicity of light-emitting elements packed at a high density.

To achieve the above objects, a color display system according to the present invention comprises a plurality of display units each composed of a body having a front panel supporting two rows of sockets thereon, two rows of light-emitting elements mounted respectively in the sockets and capable of emitting light of three primary colors, the light-emitting elements being grouped into a horizontal array of triads across the two rows of light-emitting elements, a control circuit unit accommodated in the body and including a printed-circuit board electrically connected to the sockets for controlling the light-emitting elements, and electric connector means electrically connected to the control circuit unit for external electric connection. The color display system also includes support means for supporting the display units as a matrix of horizontal rows and vertical columns, the display units being disposed closely in each of the horizontal rows and spaced in each of the vertical columns with passages defined between the display units in the vertical columns, and ventilator means disposed behind the display units for forcibly delivering air through the passages.

With the above arrangement, each single display unit supports three-primary triads of light-emitting elements with signal lines connected thereto being disposed in the body without the need for many cables for external connection. The air delivered from the ventilator means is passed through the passages between the vertically spaced display units for cooling the sockets and the light-emitting elements. The bodies of the display units are shaped so that the adjacent display units in each horizontal row are disposed closely to each other, and the sockets are disposed on the front panel of the body so that the body has a height held to a minimum. The control circuit unit housed in the display unit body is arranged to simplify the electric connector means and deliver control signals from display unit to display unit in each horizontal row. Various support arrangements are provided for stably supporting the display units which may have an increased depth.

The terms "front", "rear", "upper", and "lower" are employed with reference to the normal posture of use of the color display system throughout the specification and claims.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

The present invention will be described in detail by way of illustrative example with reference to the accompanying drawings, in which.

DESCRIPTION OF THE PREFERRED EMBODIMENTS

Figure 1:
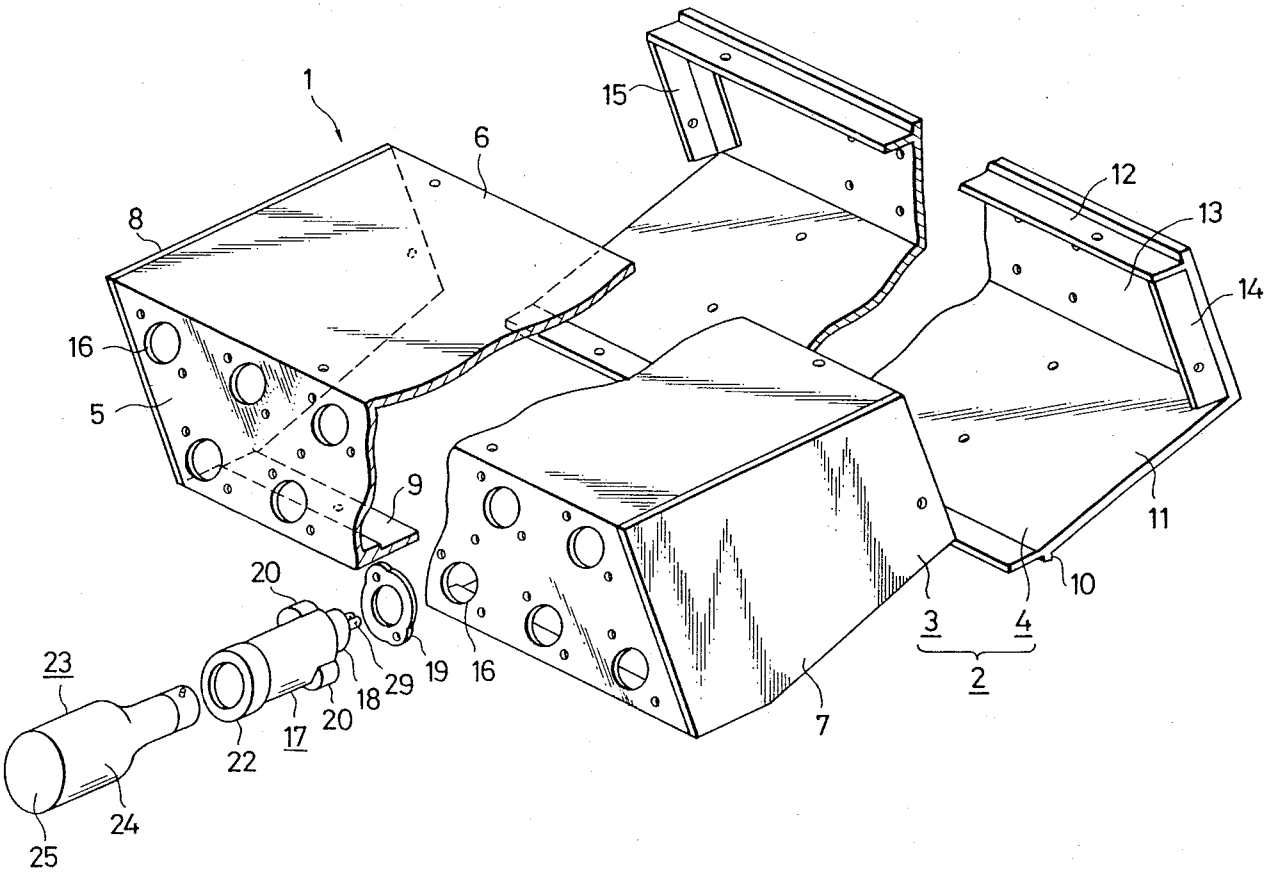
FIG. 1 is a fragmentary exploded perspective view of a display unit in a color display system according to a first embodiment of the present invention.

FIGS. 1 through 7 illustrate a color display system according to a first embodiment of the present invention, the color display system being suitable for installation in an open stadium. The color display system comprises a plurality of display units 1. Each of the display units 1 is composed of a body 2 made of metal such as aluminum, as shown in FIG. 1. The body 2 comprises an upper chassis 3 and a lower chassis 4. The upper chassis 3 has a front panel 5, an upper panel 6, a pair of side panels 7, 8, and a narrow lower panel 9 including an inner stepped portion. The front panel 5, the upper panel 6, and the lower panel 9 are integrally formed by extrusion molding, and the side panels 7, 8 are welded to the opposite side edges of the front panel 5, the upper panel 6, and the lower panel 9. The lower chassis 4 is composed of a lower panel 11 having a ridge 10 extending along a front edge thereof and projecting downwardly from a lower surface of the lower panel 11, a rear panel 13 having a ridge 12 extending along an upper edge thereof and projecting forward from an inner surface of the rear panel 13, and a pair of side ridges 14, 15 mounted on opposite ends of the inner surface of the rear panel 13. The lower and rear panels 11, 13 are integrally formed by extrusion molding, and the side ridges 14, 15 are welded to the rear panel 13.

The front panel 5 of the upper chassis 3 has two rows of socket attachment holes 16. A plurality of sockets 17 are installed respectively in the socket attachment holes 16. Each of the sockets 17 has an outer casing molded of synthetic resin and includes a terminal support 18 projecting from an end thereof through a annular water-resistant packing 19 of rubber into each of the socket attachment holes 16. The socket 17 is secured to the front panel 5 by means of screws 21 disposed behind the front panel 5 and threaded into a pair of attachment legs 20 projecting laterally from the end of the socket 17 in diametrically opposite relation. The attachment legs 20 are inclined with respect to the horizontal plane so that the attachment legs 20 of the adjacent sockets 17 will not interfere with each other and the sockets 17 can be packed at a higher density. Since the attachment legs 20 are also inclined with respect to the vertical plane, the height of the upper chassis 3 and hence the body 2 is held to a minimum for maintaining necessary ventilation spaces or air passages (described later on) between the display units 1.

Figure 2:
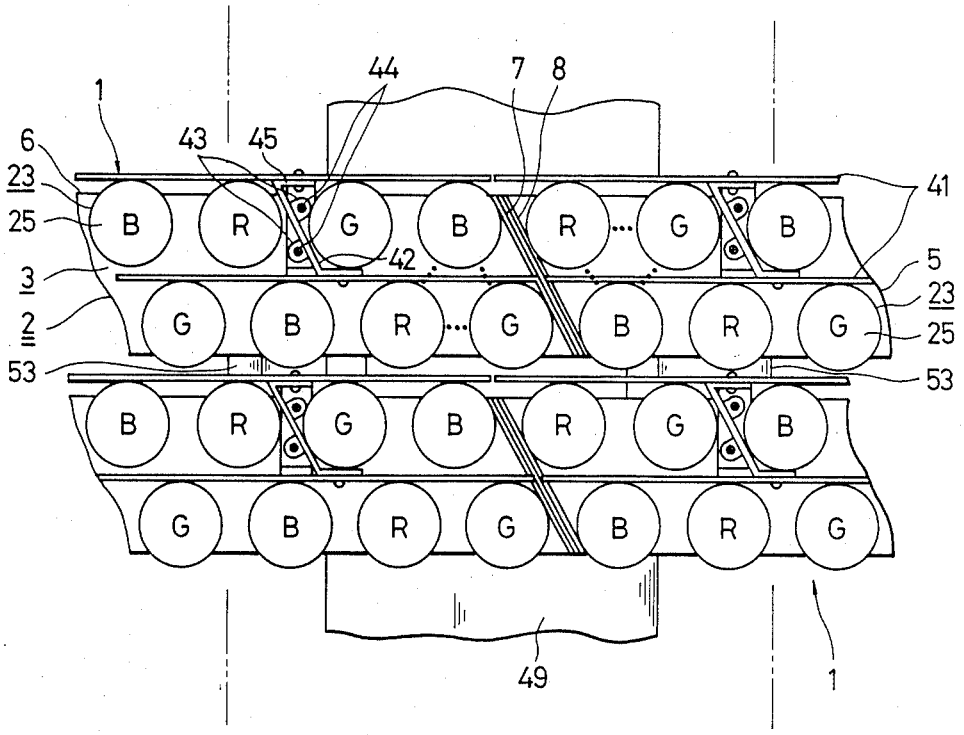
FIG. 2 is a fragmentary front elevational view of the color display system of the first embodiment.

Each socket 17 includes a water-resistant packing 22 of rubber fitted over the peripheral edge around an open end. A light-emitting element 23 is inserted through the water-resistant packing 22 into the socket 17. The light-emitting element 23 comprises an incandescent lamp having a light reflecting film 24 of metal deposited on a rear circumferential surface thereof, and a colored light transmission film 25 painted on a front surface thereof. There are three types available of the light-emitting element 23; one capable of emitting red (R) light, one capable of emitting green (G) light, and one capable of emitting blue (B) light, the red, green, and blue being three additive primaries. The light-emitting elements 23 are mounted respectively in the sockets 17 and arranged in two rows on the front panel 5 of the body 2. Three adjacent light-emitting elements 23 which emit light in the three primaries are grouped as a triad, and a plurality of triads are horizontally arranged across the two rows of the light-emitting elements 23. The three-primary triads are shaped as either a regular triangle or an inverted regular triangle, as best shown in FIG. 2. The regular and inverted regular triangles of the triads are alternately positioned along the front panel 5. The opposite sides of the body 2 are inclined at an angle of 60 degrees to the horizontal plane so as to be in conformity with the outer sides of the opposite triads.

Figure 4:
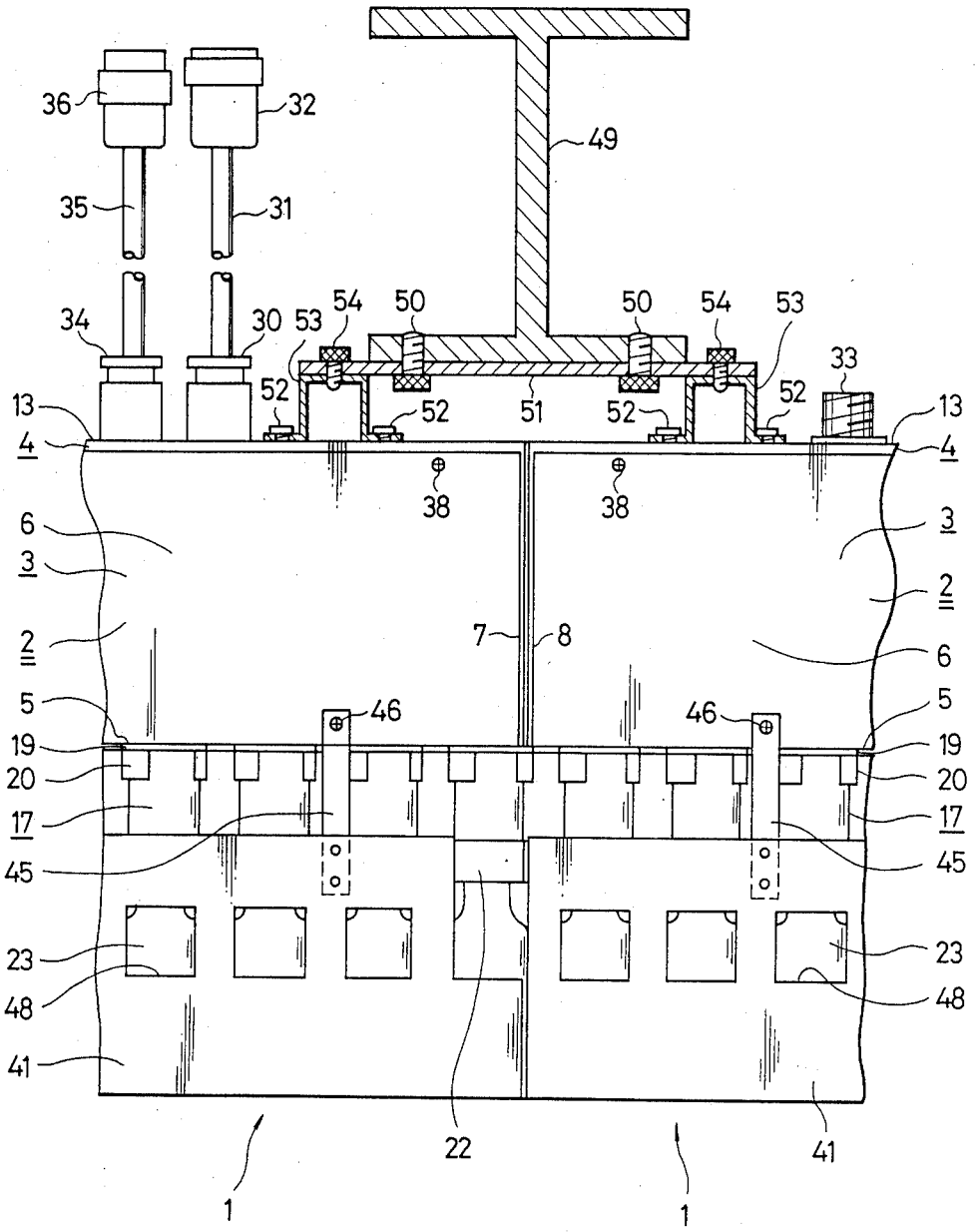
FIG. 4 is a fragmentary plan view, partly in horizontal cross section, of the color display system.
Figure 5:
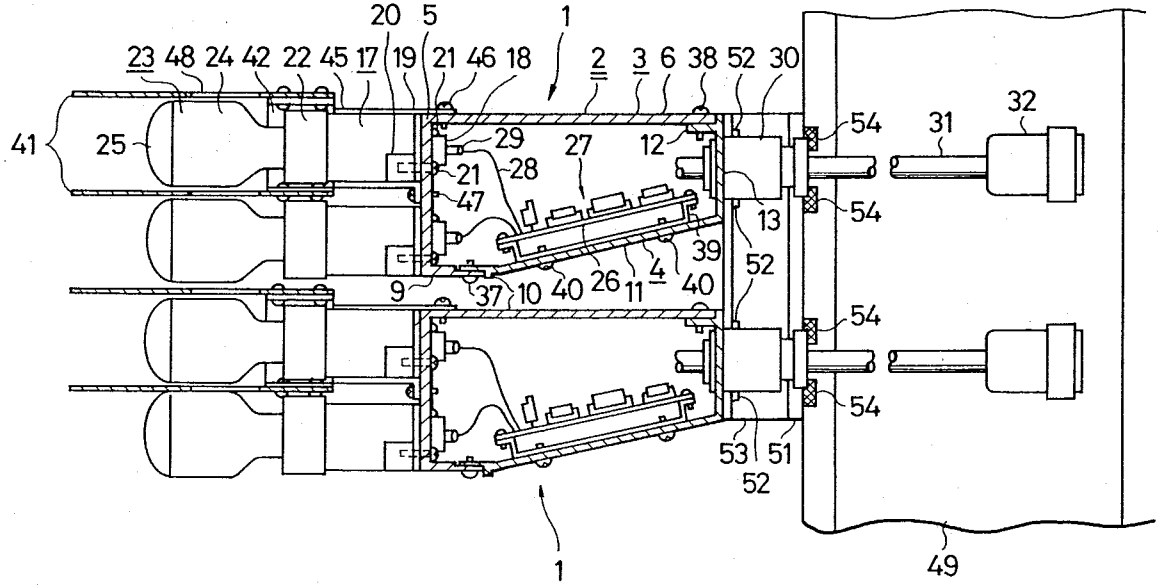
FIG. 5 is a fragmentary side elevational view, partly in vertical cross section, of the color display system.

As shown in FIG. 5, a control circuit unit 27 having a printed-circuit board 26 is accommodated in each body 2. Lead wires 28 are electrically connected between the control circuit unit 27 and terminals 29 of the sockets 17 for enabling the control circuit unit 27 to control the light-emitting elements 23 with electric signals delivered over the lead wires 28. The control circuit unit 27 will be described later in detail. The rear portion of the body 2, that is, the rear panel 13 of the lower chassis 4, supports thereon three electric connector means electrically connected to the control circuit unit 27 and to external terminals. The three electric connector means include, as shown in FIG. 4, a signal inlet composed of a cable 31 fixed by a bushing 30 to the rear panel 13 and an electric connector 32 attached to an outer end of the cable 31, a signal outlet composed of an electric connector 33 mounted on the rear panel 13, and a power supply inlet composed of a cable 35 fixed by a bushing 34 to the rear panel 13 and an electric connector 36 attached to an outer end of the cable 35.

For assembling the body 2, the front edge of the lower panel 11 of the lower chassis 4 is placed on the upper surface of the lower panel 9 of the upper chassis 3 so that the ridge 10 is held against the rear edge of the lower panel 9, and then the lower panels 9, 11 are fastened together by screws 37 (FIG. 5). The ridge 12 of the rear panel 13 of the lower chassis 4 is held against the lower surface of the rear edge of the upper panel 6 of the upper chassis 3, and the ridge 12 and the upper panel 6 are fastened to each other by screws 38. The side ridges 14, 15 are located inwardly of the rear edges of the side panels 7, 8 and fastened thereto by screws (not shown). The joints between the upper and lower chassis 3, 4 are coated with a caulking material for rendering the assembly resistant to the entry of water. The printed-circuit board 26 is supported on a support member 39 affixed by screws 40 to the lower panel 11 of the lower chassis 4.

Figure 3:
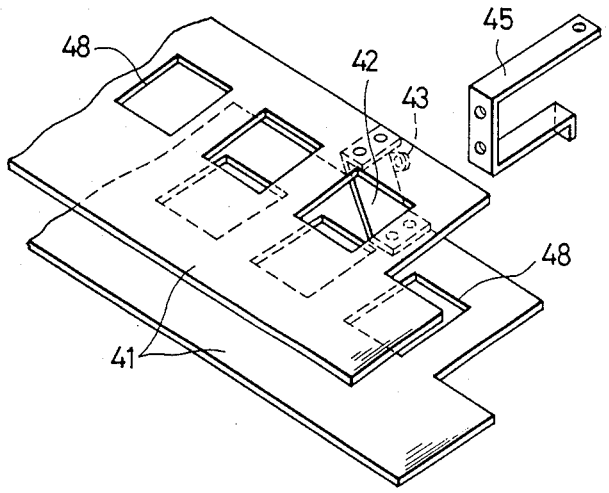
FIG. 3 is a fragmentary perspective view of light shield partitions.

As shown in FIG. 3, a pair of upper and lower light shield partitions 41 of metal is interconnected by a connector plate 42 having rear bent lug 43 which are secured by screws 44 (FIG. 2) to a front surface of an attachment leg 45. The attachment leg 45 has ends fixed by screws 46 47 (FIGS. 4 and 5) to the upper and front panels 6, 5 of the body 2. The upper and lower light shield partitions 41 are disposed one on each side of each of alternate horizontal rows of the light-emitting elements 23, so that any displayed images or patterns can clearly be seen on the matrix of the light-emitting elements even under sunlight. Each of the light shield partitions 41 has a plurality of heat radiation holes 48 for upwardly dissipating heat radiated from the light-emitting elements 23.

The display units 1 are supported by a support arrangement composed of a vertical post 49 in the form of an H-shaped steel bar and a support plate 51 of metal fastened by bolts 50 to a front surface of the vertical post 49. The vertical post 49 and the support plate 51 are positioned across a joint between the rear portions of the bodies 2, 2 of adjacent display units 1, 1. Connectors 53 are fastened by bolts 52 to the rear portions of the bodies 2, 2, respectively, and also fastened by bolts 54 to the support plate 51. Since each vertical post 49 is shared by two horizontally adjacent display units 1, 1, the number of the vertical posts 49 used is held to a minimum. This arrangement is of advantage for effective ventilation as described later. Each connector 53 extends vertically across the rear portions of a plurality, two for example, of vertcailly adjacent bodies 2, 2, so that the two vertically connected display units 1, 1 can be handled as one unit during transportation. The support plate 51 has the same height as that of the connectors 53, 53 and fixed thereto, so that one support plate 51 supports four display units 1. The display units 1 are disposed horizontally adjacent to each other with substantially no gap therebetween and vertically spaced at small distances or intervals left therebetween.

Figure 6:
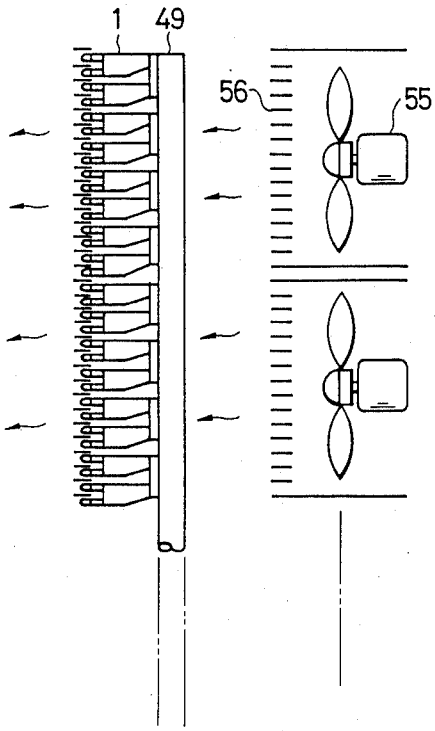
FIG. 6 is a fragmentary side elevational view of the color display system, showing a ventilator device.
Figure 7:
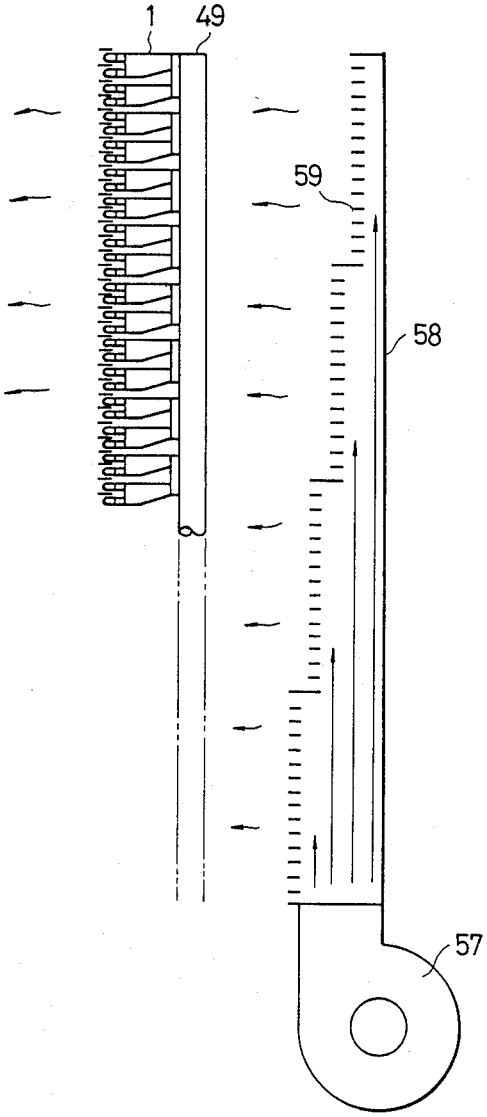
FIG. 7 is a fragmentary side elevational view of a color display system with a different ventilator device.

FIGS. 6 and 7 illustrate different ventilators positioned behind the vertical post 49 on which the display units 1 are supported. As shown in FIG. 6, the ventilator comprises a plurality of ventilator fans 55 and a louver 56 placed in front of the ventilator fans 55. The ventilator shown in FIG. 7 includes a single ventilator fan 57 located in a lower position, a hood or duct 58 for directing an upward stream of air from the ventilator fan 57 into a horizontal direction, and a stepped louver 59 mounted in front openings in the duct 58. The air streams from the ventilator flow through the passages between the vertically spaced display units 1 in the directions of the arrows (FIGS. 6 and 7) to cool the sockets 17, the water-resistant packings 22, and the light-emitting elements 23. Since the lower panels 11 of the bodies 2 are inclined upwardly and rearwardly, as shown in FIG. 5, the air streams are guided by the sloping lower panels 11 smoothly into the passages between the display units 1.

The ventilator fans 55, 57 may be rotated in a reverse direction to direct air flows in a direction opposite to that of the arrows shown in FIGS. 6 and 7 through the passages between the display units 1. Thus, the sockets 17, the water-resistant packings 22, and the light-emitting diodes 23 can also be cooled for heat radiation. This mode of operation is adavantageous in that the level of noise produced by the color display system and radiated into the surrounding environment can be reduced.

The electric connector 32 of the signal inlet of a display unit 1 is connected to the electric connector 33 of the signal outlet of a horizontally adjacent display unit 1, so that electric signals can be fed horizontally from display unit to display unit. The vertically adjacent display units 1 are not electrically connected and hence there is no electric signal delivered vertically from display unit to display unit. Accordingly, there is required no cable for vertical signal transfer, and the wiring procedure for electrically connecting the display units 1 can be simplified. The electric connector 36 of the power supply inlet is connected to a power supply (described later on). The light-emitting elements 23 may be arranged in other patterns. For example, each three-primary emitting set may comprise two light-emitting elements capable of emitting blue light which is relatively weak in intensity, a single light-emitting element capable of emitting red light, and a single light-emitting element capable of emitting green light, the four light-emitting elements being positioned on the corners of a square. With this modified arrangement, the opposite sides of the body 2 may be vertical, rather than inclined at 60 degrees to the horizontal plane as illustrated.

Figure 8:
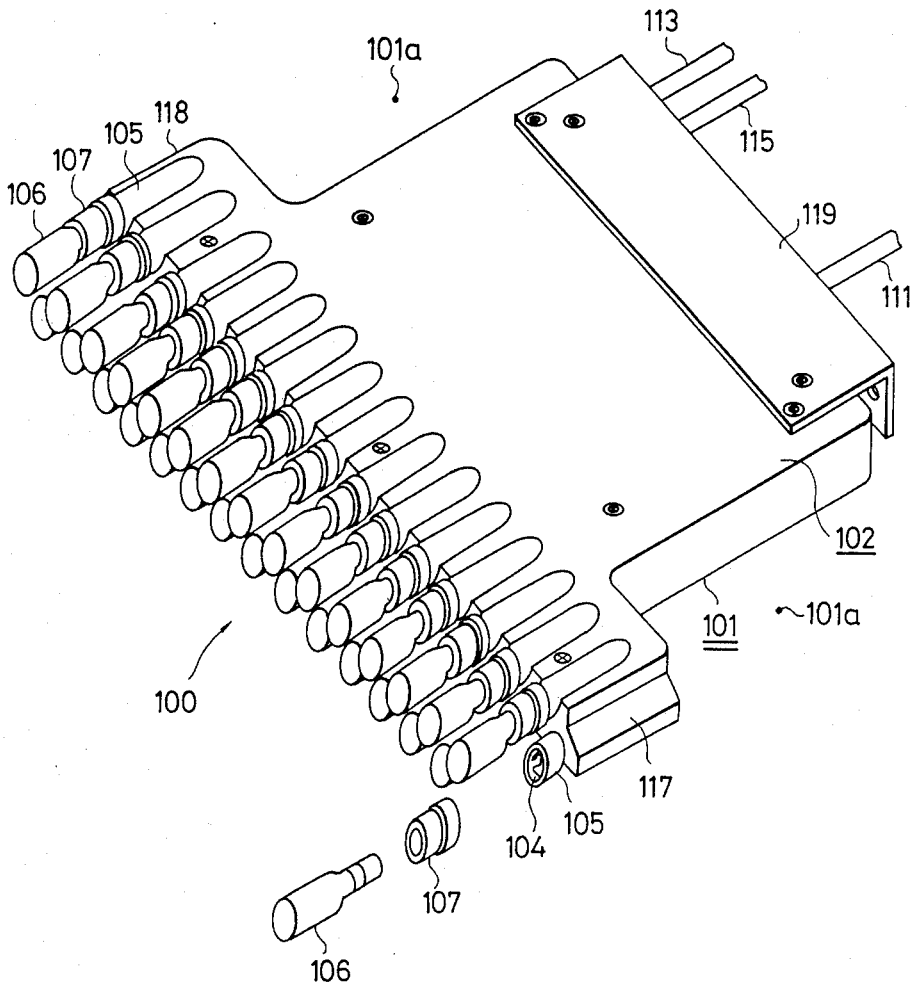
FIG. 8 is a perspective view of a display unit in a color display system according to a second embodiment of the present invention.
Figure 9:
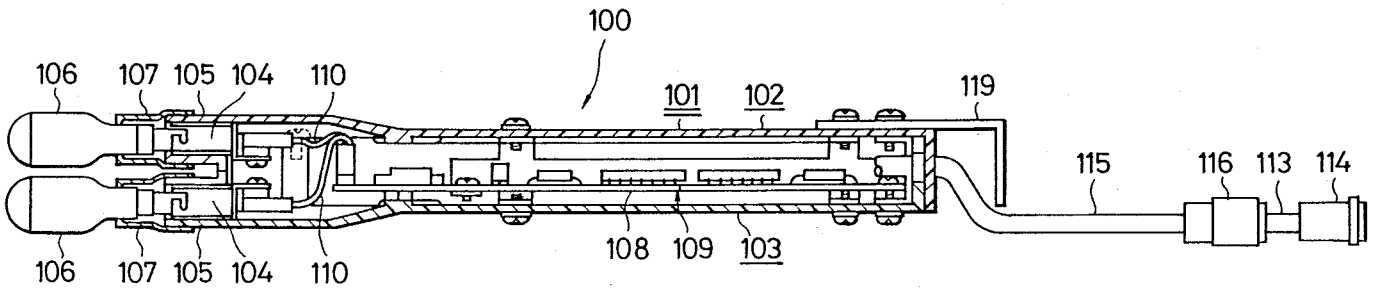
FIG. 9 is a vertical cross-sectional view of the display unit shown in FIG. 8.
Figure 10:
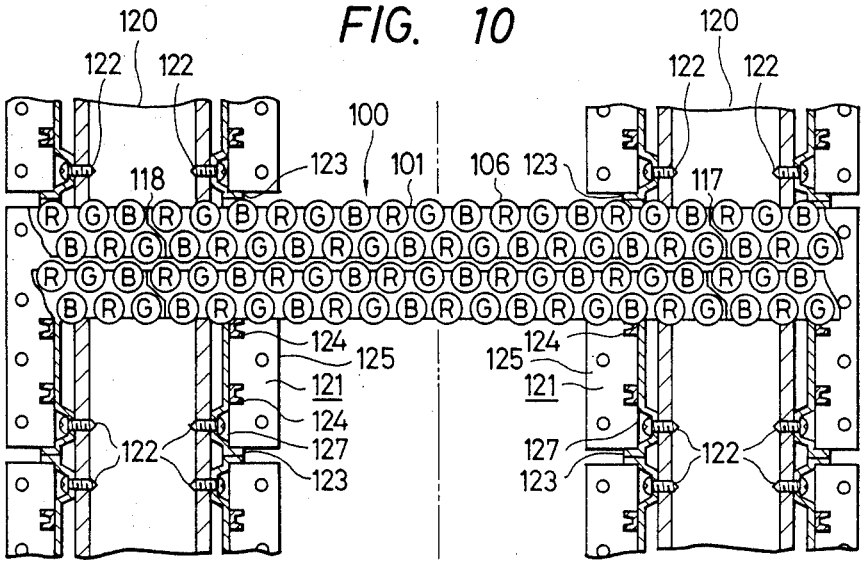
FIG. 10 is a fragmentary front elevational view, with parts in vertical cross section, of the color display system according to the second embodiment.
Figure 12:
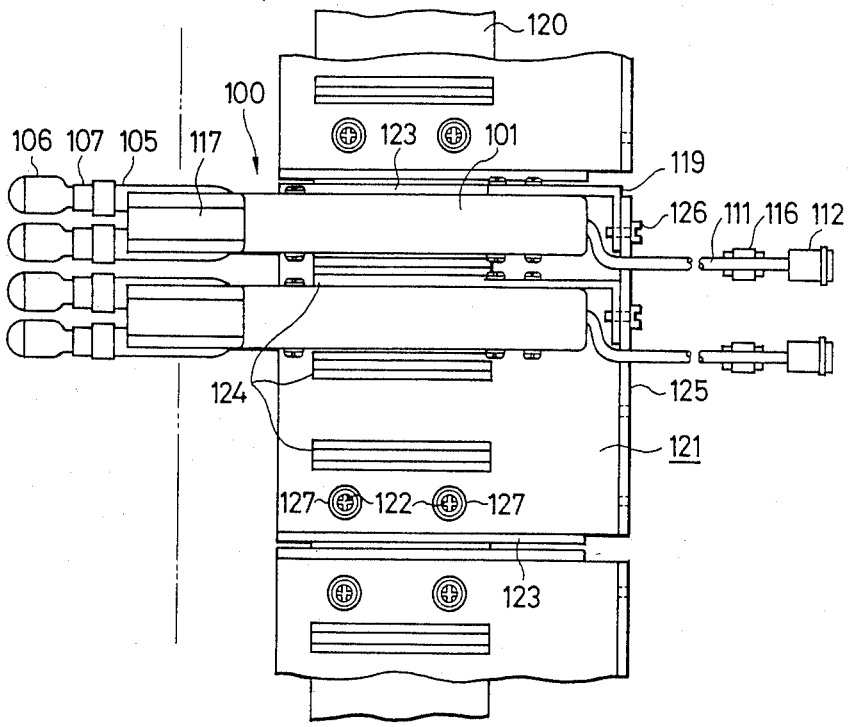
FIG. 12 is a fragmentary side elevational view of the color display system.

FIGS. 8 through 17 illustrate a color display system constructed in accordance with a second embodiment of the present invention. The color display system of the second embodiment is particularly suitable for use in an indoor arena or as a mobile display system on a large-size trailer. The color display system is composed of a plurality of display units 100 each including a body 101 of synthetic resin comprising, as shown in FIGS. 8 and 9, an upper chassis 102 and a lower chassis 103. The body 101 has on its front face a plurality of tubular casings 105 serving as outer shells of sockets 104, respectively. Two rows of light-emitting elements 106 grouped as three-primary triads are horizontally mounted by the sockets 104 in front end portions of the tubular casings 105. The light-emitting elements 106 are smaller in size than the light-emitting elements 23 according to the preceding embodiment, but are arranged in the same pattern as that of the light-emitting elements 23. An annular water-resistant packing 107 of rubber is fitted over a front end of each of the tubular casings 105, with the light-emitting element 106 being inserted through the water-resistant packing 107 into the socket 104.

As illustrated in FIG. 9, a control circuit unit 109 including a printed-circuit board 108 is housed in each body 101. The control circuit unit 109 is electrically connected by lead wires 110 to the sockets 104 for controlling the light-emitting elements 106. The control circuit unit 109 will later be described in detail.

Figure 11:
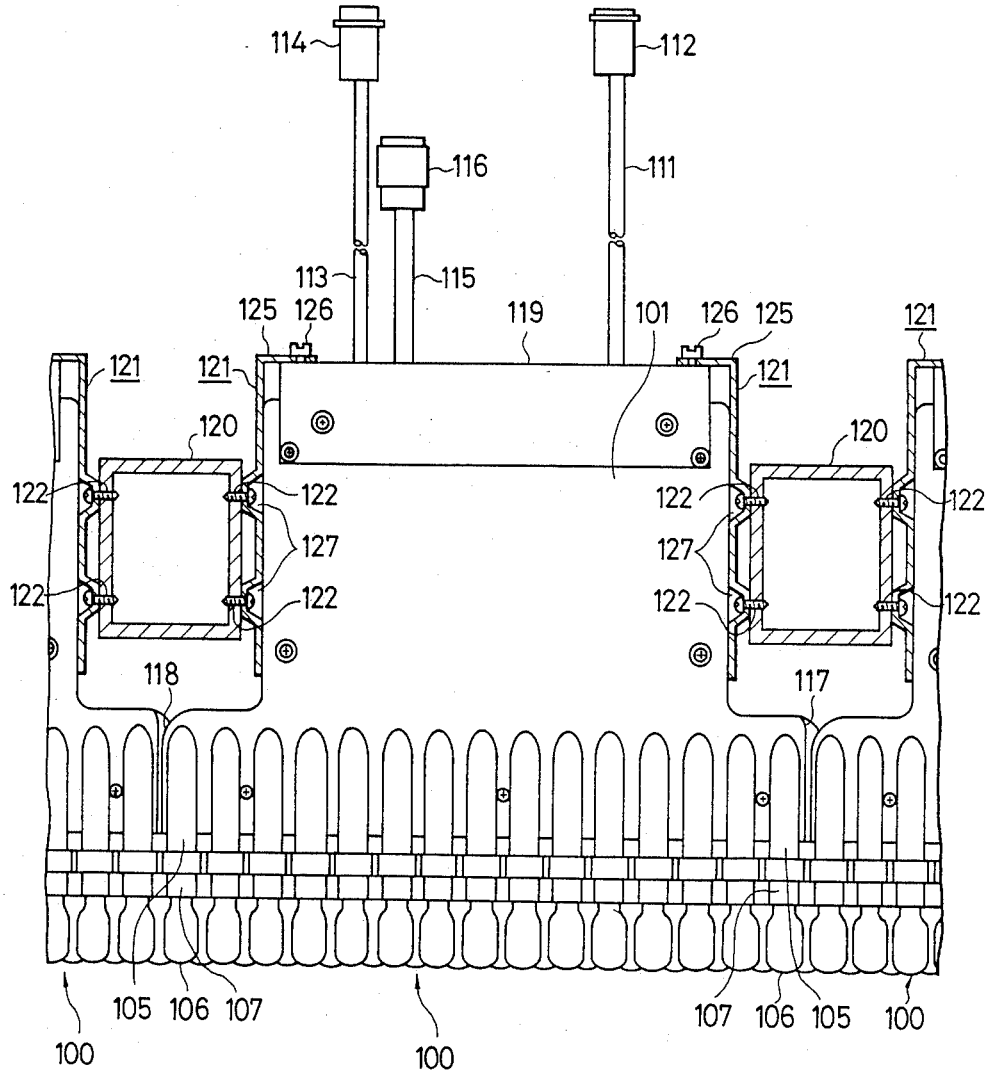
FIG. 11 is a fragmentary plan view, with parts in horizontal cross section, of the color display system of FIG. 10.

The body 101 supports on the rear portion thereof three electric connector means electrically connected to the control circuit unit 109 and to external terminals. The three electric connector means include, as shown in FIG. 11, a signal inlet composed of a cable 111 extending from the rear portion of the body 101 and an electric connector 112 attached to an outer end of the cable 111, a signal outlet composed of a cable 113 extending from the rear portion of the body 101 and an electric connector 114 attached to an outer end of the cable 113, and a power supply inlet composed of a cable 115 extending from the rear portion of the body 101 and an electric connector 116 attached to an outer end of the cable 115.

As shown in FIG. 8, the body 101 has opposite sides 117, 118 inclined in conformity with the sides of opposite triads of light-emitting elements 106, and any horizontally adjacent display units 100 are located as closely to each other as possible. The body 101 has rear side recesses **101*a*, 101*a* defined behind the opposite sides 117, 118 so that the body 101** can easily be supported in position as described later on.

The tubular casing 105 has an upper portion projecting upwardly beyond an upper surface of the body 101, and a lower portion projecting downwardly beyond a lower surface of the body 101, for increased heat radiation through ventilation as described later on. As shown in FIGS. 8 and 9, a substantially L-shaped attachment 119 is fixed by screws to a rear upper surface of the body 101.

Figure 13:
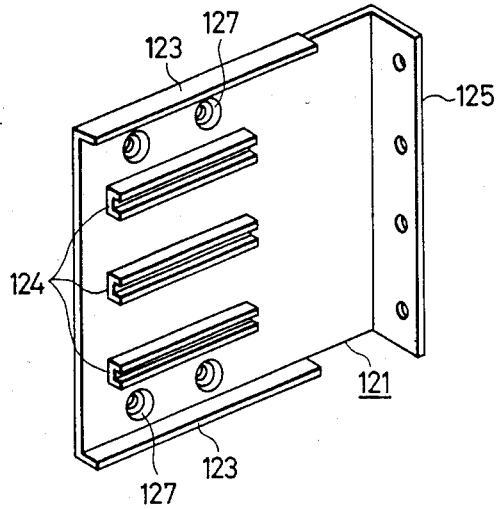
FIG. 13 is a perspective view of a support rack.

FIGS. 10 through 13 show a support arrangement for the display units 100. The support arrangement comprises vertical posts 120 and support racks 121. The posts 120 are positioned respectively in the rear side recesses **101*a* in the bodies 101 of horizontally adjacent display units 100, 100. The horizontally adjacent display units 100 are secured to the posts 120 by the support racks 121 fixed by screws 122 to opposite sides of the posts 120. Two symmetrical support racks 121 are employed as a pair capable of supporting a plurality (four for example) of vertically adjacent display units 100. As illustrated in FIG. 13, each of the suport racks 121 has upper and lower bent flanges 123, a plurality of vertically spaced partitions 124 disposed between the upper and lower flanges 123, and a rear bent flange 125. The display units 100 are guided at their rear portions between the flanges 123 and the partitions 124 when the display units 100 are inserted. After the display units 100 are inserted until the attachments 119 are held against the flange 125, screws 126 are threaded through the flange 125 into the attachment 119, thereby fastening the display units 100 to the support racks 121. The edges of each support rack 121 which define the holes for the screws 122 are recessed away from the display unit 100 toward the post 120, so that the screws 122 have their heads disposed in the recessed portions out of interference with the display units 100 when the latter are slid along the support rack 121. With the foregoing support arrangement, the display units 100** are located in horizontally adjacent relation and spaced vertically with small distances or passages therebetween.

The same ventilator as that shown in FIGS. 6 or 7 may be used with the color display system according to the second embodiment for passing air through the passages between the vertically arranged display units 100 to thereby cool the tubular casings 105, the water-resistant packings 107, and the light-emitting elements 106. The heat radiated by the display units 100 can effectively be dissipated from the portions of the tubular casings 105 which project upwardly and downwardly into the passages between the display units 100. Such a tubular construction can easily be achieved since the body 101 is molded of synthetic resin, and is advantageous in that the outer shells 105 of the sockets 104 that will be heated up to a high temperature can be formed with the body 101. The display units 100 have a relatively large depth, and would not be stably supported by rear supports. The support arrangement of the invention supports the sides of the display units 100 at the recesses **101*a* defined behind the opposite sides 117, 118 of the bodies 101. This allows the display units 100** to be stably supported in position.

Figure 14:
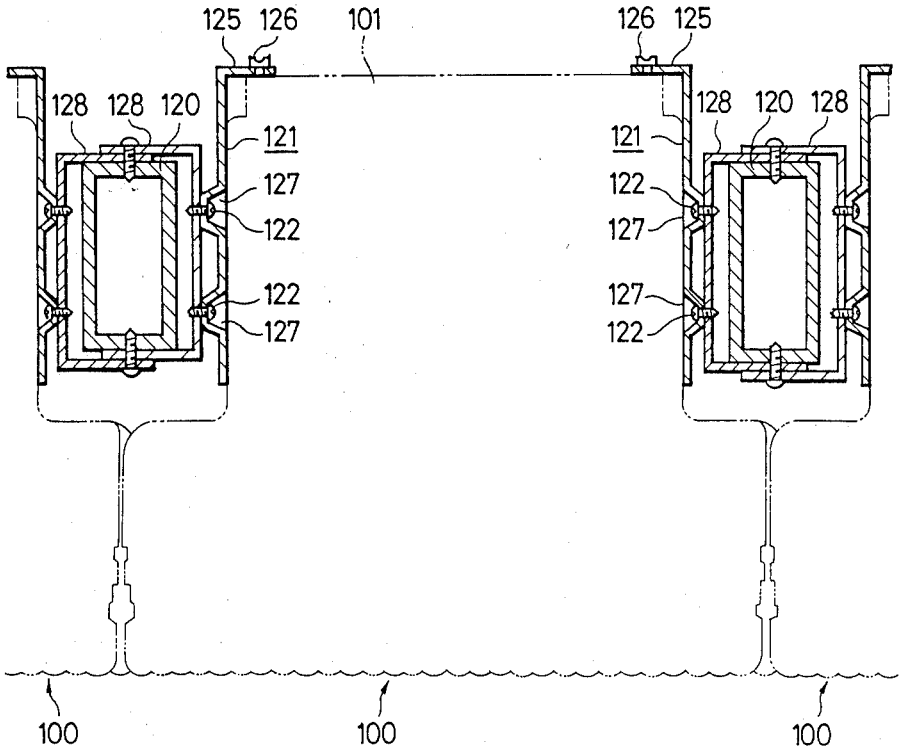
FIG. 14 is a fragmentary plan view of a color display system having a modified support arrangement which is shown in horizontal cross section.

FIG. 14 shows a modified support arrangement composed of vertical posts 120, channel-shaped auxiliary support members 128 fastened by screws to opposite sides of the vertical posts 120, and support racks 121 fixed by the auxiliary support members 128 to the vertical posts 120.

Figure 15:
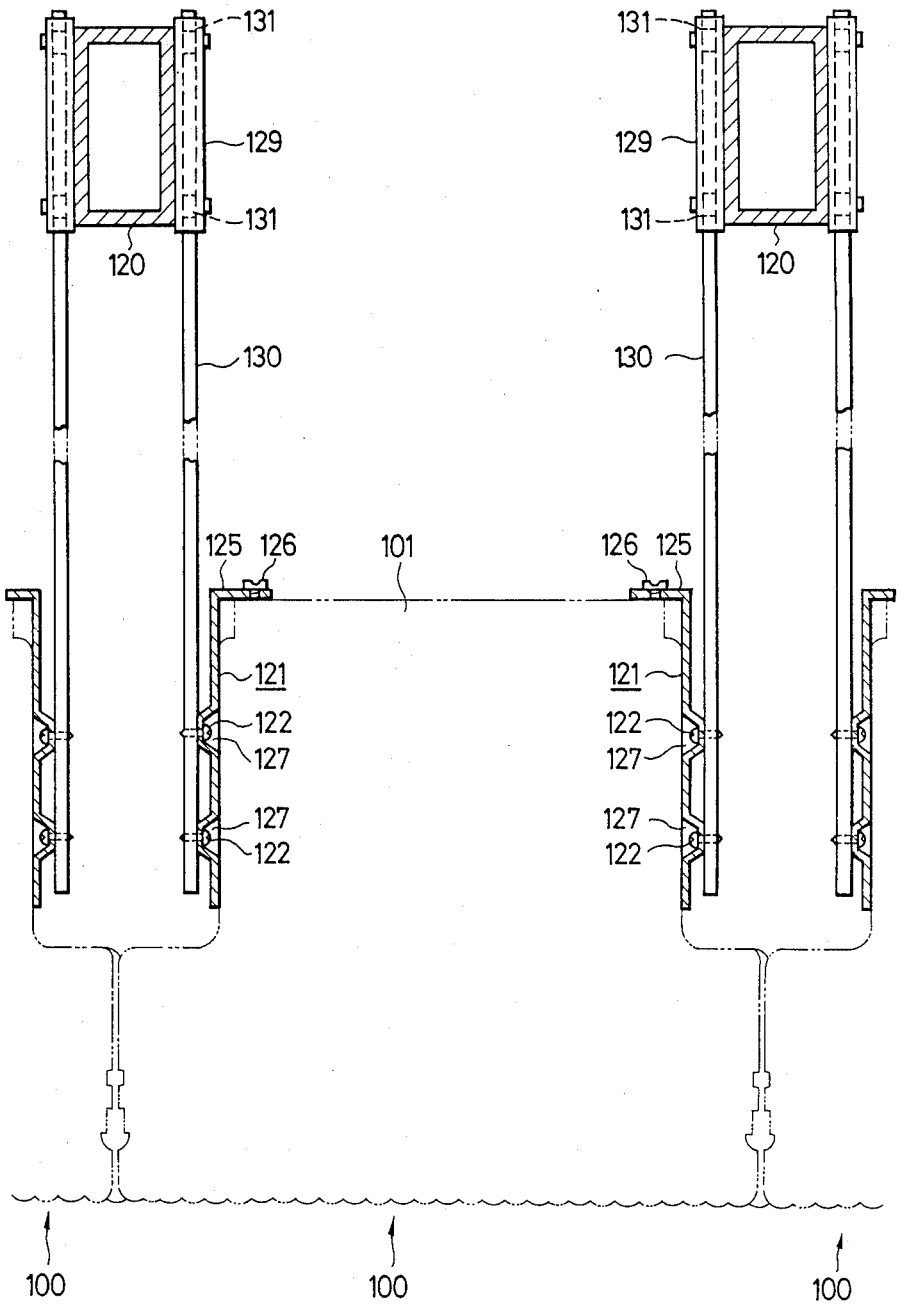
FIG. 15 is a fragmentary plan view of a color display system having another modifield support arrangement illustrated horizontal cross section.
Figure 16:
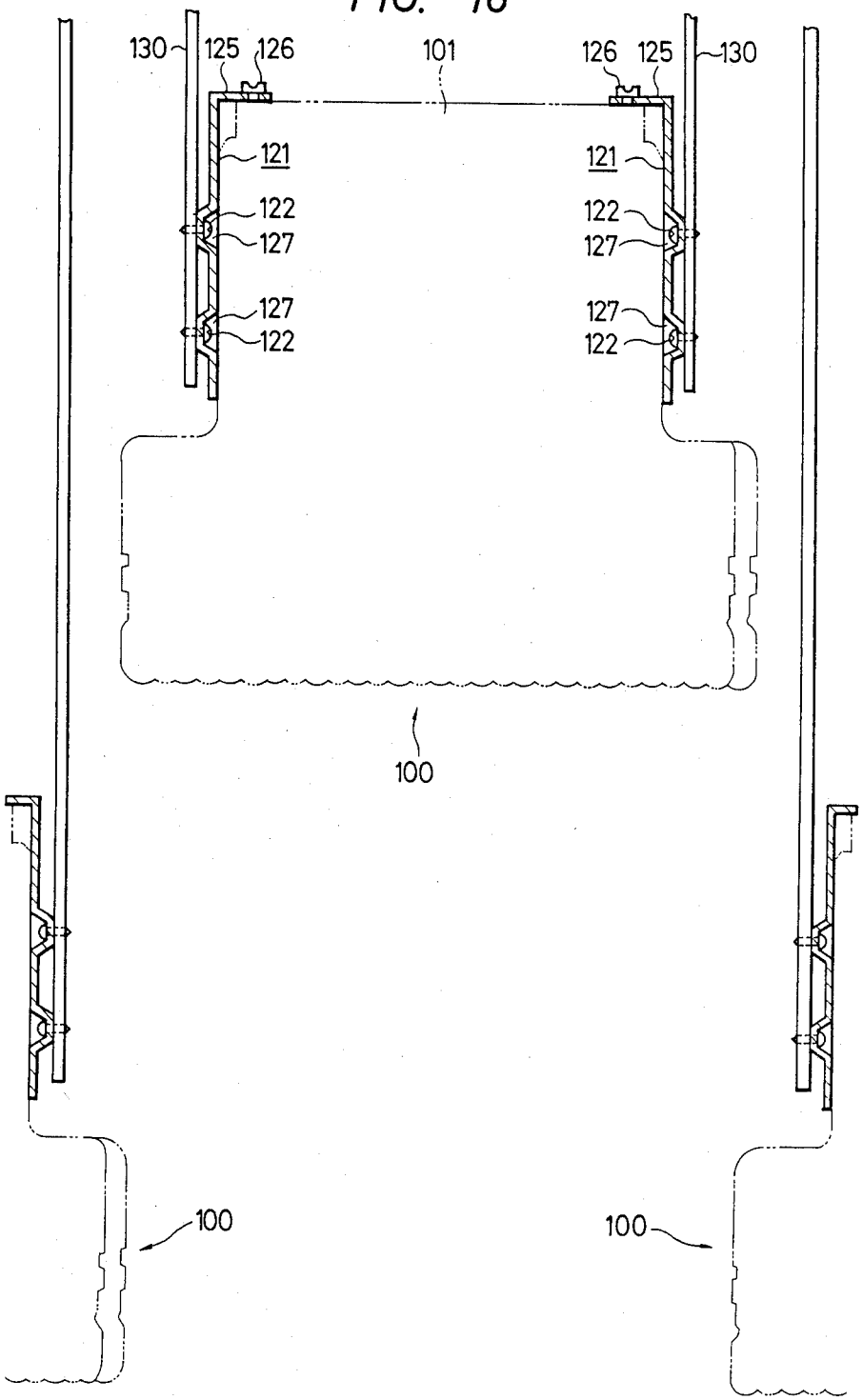
FIG. 16 is a fragmentary plan view of the color display system of FIG. 15, showing a display unit in a retracted position.
Figure 17:
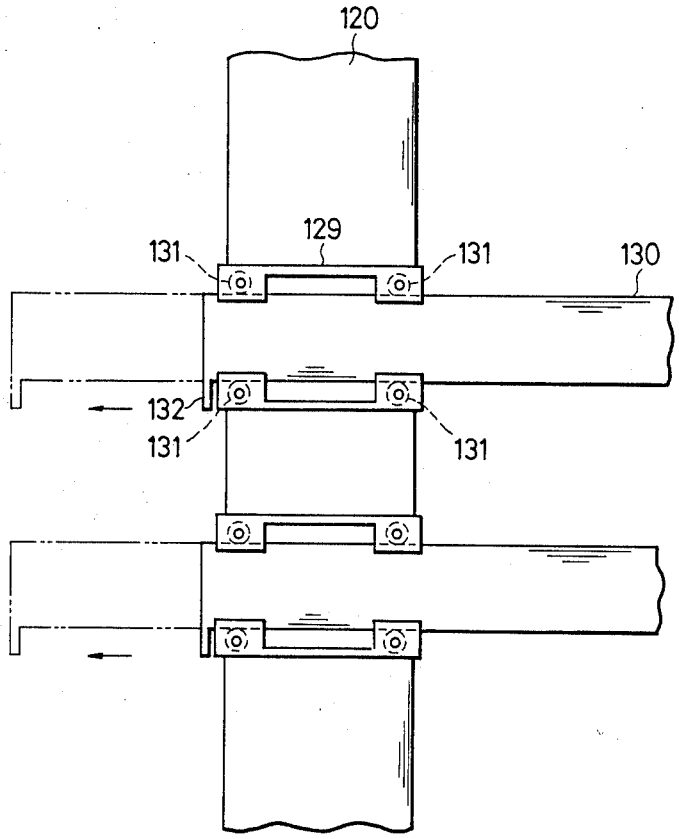
FIG. 17 is a fragmentary side elevational view of the support arrangement shown in FIG. 15.

According to still another modification shown in FIGS. 15 through 17, a support arrangement comprises vertical posts 120 disposed behind the horizontally adjacent display units 100 and aligned with their joints, arms 130 retractably extending through guides 129 of metal fixed to opposite sides of the posts 120, and support racks 121 secured to the sides of ends of the arms 130 and positioned in the rear side recesses **101*a* in the bodies 101, the support racks 121 being fastened to the bodies 101. As shown in FIG. 17, each guide 129 has four guide rollers 131 rollingly supporting the upper and lower surfaces of one of the arms 130. When the arms 130 are in the most advanced position as shown in FIGS. 15 and 17, stoppers 132 on the arms 130 are held against the rear ends of the guides 129 to keep the display units 100 in their normal position. When selected arms 130 are slid in a rearward direction, the display unit 100 secured to the selected arms 130 is positioned rearward of the rear ends of the other adjacent display units 100 as shown in FIG. 16. In this position, the screws 126 may be removed and the display unit 100 may be slid forward out of the support racks 121** for servicing. This is advantageous in applications where the color display system is installed in an elevated position and hence cannot be serviced from the front face thereof.

The display units 100 may directly be secured to the arms 130 without the intermediary of the support racks 121. In the support arrangement shown in FIG. 11, the display units 100 may also directly be attached to the posts 120. Similarly, in the support arrangement of FIG. 14, the display units 100 may directly be attached to the auxiliary support members 128. However, use of the support racks 121 is more advantageous in that a plurality of display units 100 can be transported as one unit since they are supported together by the support racks 121, 121 secured thereto by the screws 126.

The body 101 is assembled by combining the upper and lower chassis 102, 103, fastening them with screws, and applying a caulking material to the joints of the upper and lower chassis 102, 103. For electric connection, the electric connector 112 of the signal inlet of one display unit 100 is connected to the electric connector 114 of the signal outlet of a horizontally adjacent display unit 100. Vertically stacked display units 100 are not electrically interconnected.

Figure 18:
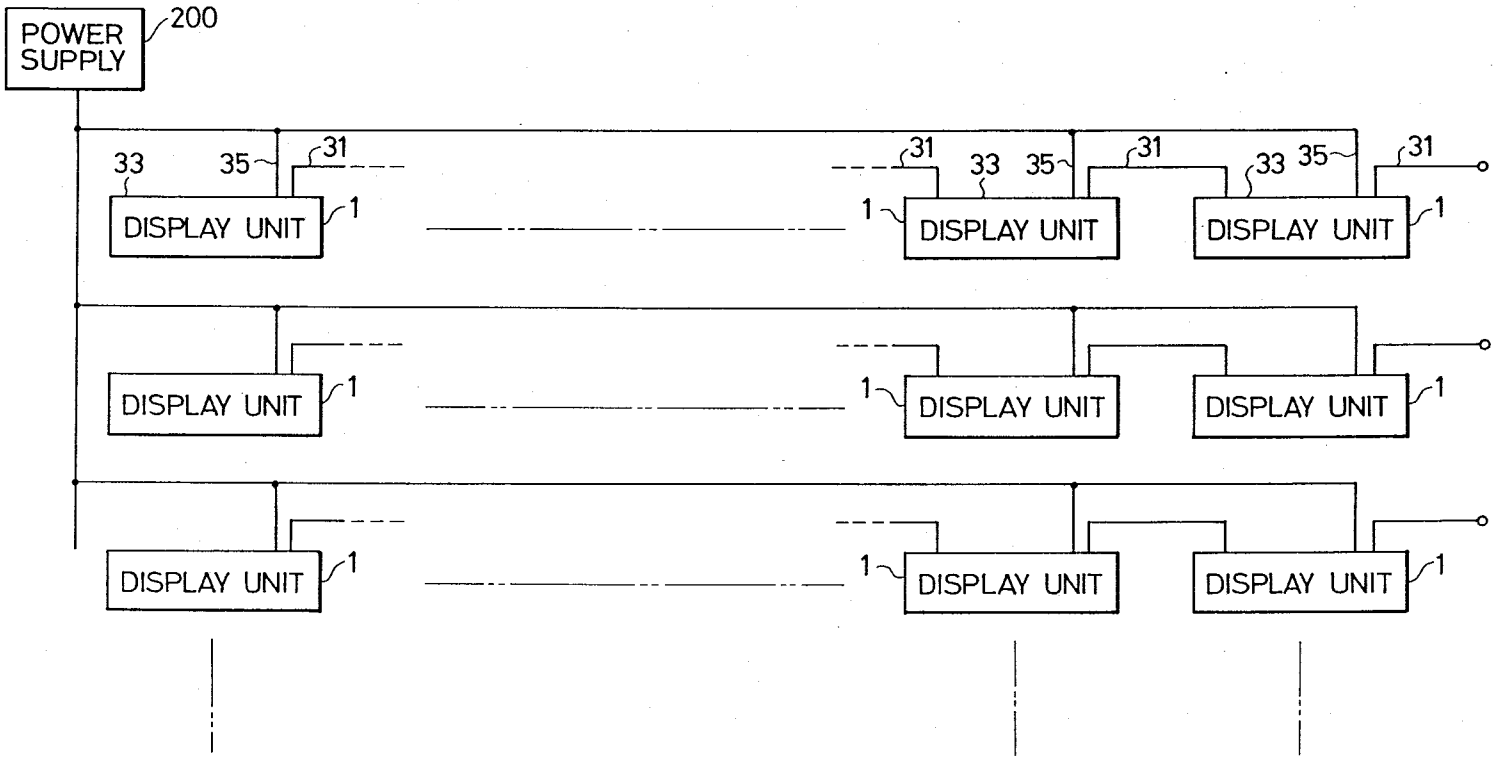
FIG. 18 is a diagram of an electric wiring arrangement for the color display system according to the first embodiment.

FIG. 18 shows an electric wiring arrangement for the color display system of the first embodiment in which the display units 1 are arranged as a matrix in horizontal rows and vertical columns, the display units 1 being electrically connected. In each horizontal row of display units 1, electric signals are supplied from a signal inlet cable 31 (shown at a righthand end) to the display unit 1 connected thereto. The signals are then fed from the electric connectors 33 of the display unit 1 over a next cable 31 to a following display unit 1. Likewise, the signals are delivered through the succession of display units 1 until the signals reach the display unit 1 at the lefthand end. The signal delivery cables 31 are interconnected only between the horizontally arrayed display units 1, and not between the vertically arrayed display units 1. Accordingly, the electric connection between the display units 1 is relatively simple and easy to perform. The cables 35 extending as the power supply inlets from the display units 1 are all connected to a power supply 200. The display units 100 according to the second embodiment are electrically connected in the same pattern as that shown in FIG. 18.

Figure 19:
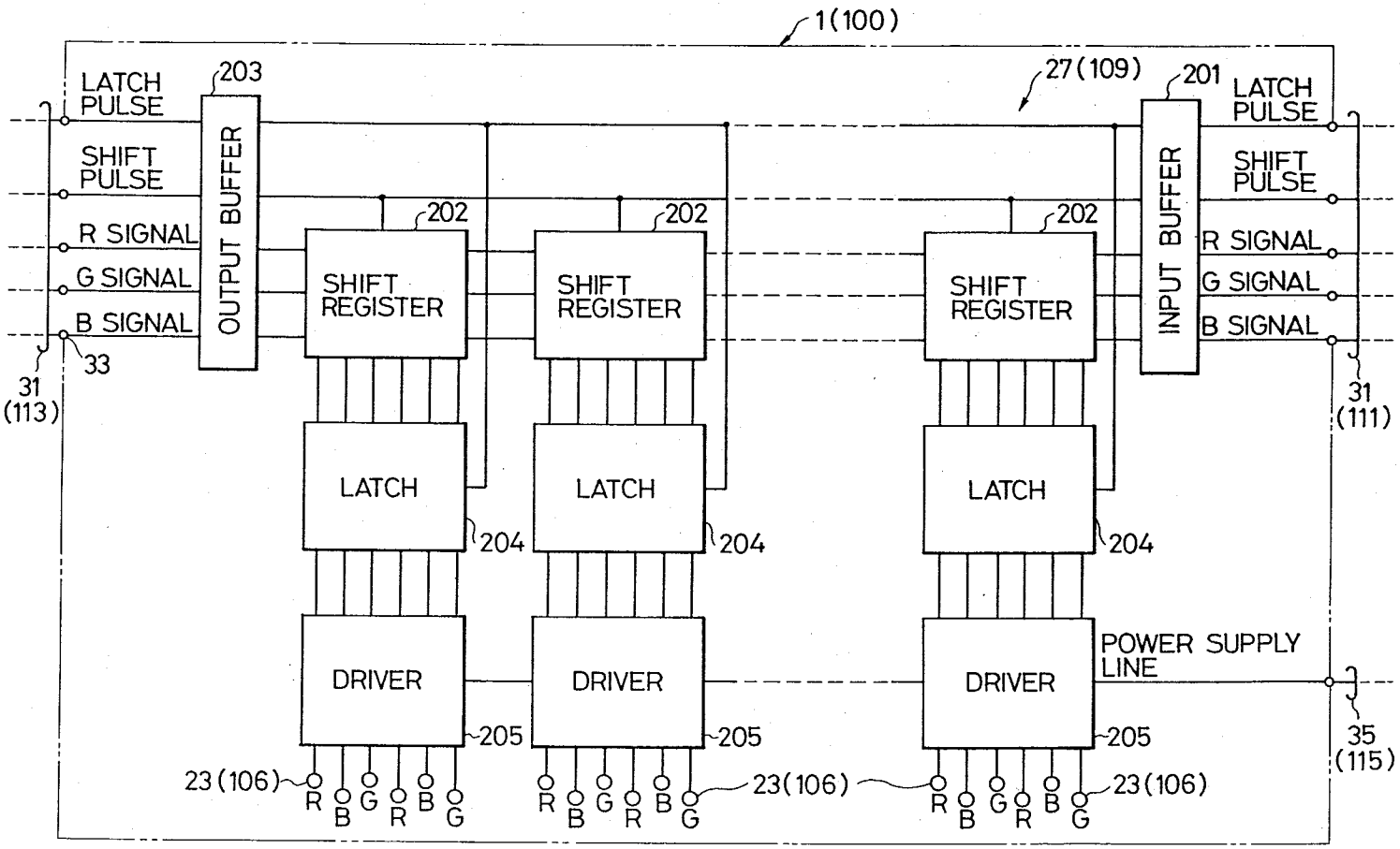
FIG. 19 is a block diagram of an electric control circuit for the color display systems according to the first and second embodiments.

FIG. 19 is a block diagram of the control circuit unit 27 (109). There are employed five types of electric signals; three R, G, B signals which are pulse-width modulated, a shift pulse signal, and a latch pulse signal. The five signals delivered from the cables 31 (111) are fed through the input buffer 201 into the display unit 1 (100). Except for the latch and shift pulse sigals, the R, G, B signals are delivered through a plurality of shift registers 202 to an output buffer 203. The latch and shift pulse signals and the R, G, B signals are then issued from the output buffer 203 over the cables 31 (113) to a next display unit 1. The shift registers 202 serve to shift the R, G, B signals and apply their output signals through latches 204 to drivers 205 for driving the light-emitting elements 23 (106) with pulse-width modulated signals to display images or patterns in desired color tones. The shift pulse signal as it is fed from the input buffer 201 is applied to each of the shift registers 202 for enabling the latter to shift the R, G, B signals. The latch pulse signal as it is fed from the input buffer 201 is applied to each of the latches 204 to latch the R, G, B signals. The input and output buffers 201, 203 may be dispensed with in the control circuit unit 27 (109).

The basic arrangement of the color display systems according to the present invention has the following advantages:

(1) Each display unit has two rows of light-emitting elements mounted in respective sockets disposed on the front face of a display unit body, the light-emitting elements being capable of emitting light of three primary colors and grouped as triads horizontally arrayed across the two rows of light-emitting elements. Thus, each display unit has triads of three-primary light-emitting elements with signal lines connected to the triads being bunched up in the display unit. Accordingly, the procedure for laying and connecting the signal lines is facilitated by the appropriately unitized display units.

(2) The control circuit unit with the printed-circuit board electrically connected to the sockets for controlling the light-emitting elements is accommodated in the body of each display unit. The control circuit unit is electrically connected to the sockets within the display unit body without requiring any outside cables for connection to the sockets. This keeps the required cables for connection to external sources or terminals to a minimum, so that the operation for laying and connecting the cables is simplified at the time the color display system is installed. The wiring construction needs substantially no space or only a small space for the cables, and contritutes to a reduction in the installation cost.

(3) The display units are vertically spaced with small gaps or passages left therebetween for admission therethrough of air supplied from the ventilator to cool the sockets and light-emitting elements arranged in two rows on each display unit. Consequently, the sockets and light-emitting elements are kept at a relatively low temperature during operation of the color display system, and hence will have a higher reliability and a longer service life. Since the cables need only a small installation space at most, a sufficient space is available for installing the ventilator therein behind the display units. As there is no control circuit unit disposed outside and rearward of each dislay unit, the ventilator can be located as closely to the display units as possible for an increased ventilation effect.

Although certain preferred embodiments of the present invention have been shown and described in detail, it should be understood that various changes and modifications may be made therein without departing from the scope of the appended claims.

What is claimed is:

1. A color display system comprising:

(a) a plurality of display units each composed of a body having a front panel, a rear panel, and a pair of rear side recesses, said front panel supporting a plurality of sockets thereon, and a plurality of light-emitting elements mounted respectively in said sockets and capable of emitting light of three primary colors, said light-emitting elements being grouped into a horizontal array of triads of said light-emitting elements on each of said display units, a control circuit unit housed in each said body for controlling said light-emitting elements, said control circuit unit including a printed-circuit board electrically connected to said sockets, and electric connector means mounted on said body and electrically connected to said control circuit unit for external electric connection; and (b) support means for supporting said display units as a matrix of horizontal rows and vertical columns, said support means comprising vertical posts positioned in said rear side recesses in adjacent display units in each of said horizontal rows, said adjacent display units being mounted on said vertical posts.

2. A color display system according to claim 1 wherein said support means further comprises support racks fixed to opposite sides of said vertical posts and disposed in said rear side recesses in a selected number of adjacent display units in each of said vertical columns, said support racks supporting rear portions of said selected number of display units, said display units being fixed through said support racks to said vertical posts.

3. A color display system according to claim 1 or 2, wherein said support means further comprises auxiliary support members fixed to said vertical posts, said display units being fixed through said auxiliary support members.

4. A color display system according to claim 2, wherein each said display unit includes an attachment fixed to said body, each of said support racks comprising a pair of upper and lower flanges, spaced partitions disposed between said upper and lower flanges, and a rear flange, said rear portions of said selected number of display units being supported between adjacent pairs of said upper and lower flanges and said spaced partitions, said attachment being held against and fixed to said rear flange.

5. A color display system comprising:

(a) a plurality of display units each composed of a body having a front panel supporting two rows of sockets thereon, two rows of light-emitting elements mounted respectively in said sockets and capable of emitting light of three primary colors, said light-emitting elements being grouped into a horizontal array of triads formed of said two rows of light-emitting elements, a control circuit unit for controlling said light-emitting elements, said control circuit unit housed in said body and including a printed-circuit board electrically connected to said sockets, and electric connector means mounted on said body and electrically connected to said control circuit unit for external electric connection;

(b) support means for supporting said display units in a matrix of horizontal rows and vertical columns, said display units being disposed closely in each of the horizontal rows and spaced in each of the vertical columns with passages defined between said display units in said vertical columns; and (c) ventilator means disposed behind said display units for forcibly delivering air through said passages wherein said body includes a rear panel, said control circuit unit in each of said display units comprising shift registers for shifting pulse-width modulated color signals for display in color tones, latches for latching output signals from said shift registers, and drivers responsive to output signals from said latches for energizing said light-emitting elements, said electric connector means in each of said display units being attached to said rear panel and including a signal inlet for applying said color signals and a shift pulse signal to said shift registers and applying a latch pulse signal to said latches, a signal outlet for delivering out said color signals from said shift registers, said shift pulse signal, and said latch pulse signal, and a power supply inlet for supplying electric power to said control circuit unit, said signal inlets and signal outlets of adjacent display units in each of said horizontal rows being electrically connected, further including a power supply to which said power supply inlets of all of said display units are electrically connected.

6. A color display system as recited in claim 1 wherein said plurality of light emitting elements and sockets therefor are arranged in two rows, and wherein said display units are disposed closely adjacent to one another in the horizontal rows of said matrix, said display units being spaced apart from each other in the vertical columns of said matrix for defining passages therebetween.

7. A color display system comprising:

(a) a plurality of display units each composed of a body having a front panel and a rear panel, said front panel supporting a plurality of sockets thereon, and a plurality of light-emitting elements mounted respectively in said sockets and capable of emitting light of three primary colors, said light-emitting elements being grouped into a horizontal array of triads of said light-emitting elements on each of said display units, a control circuit unit housed in each said body for controlling said light-emitting elements, said control circuit unit including a printed-circuit board electrically connected to said sockets, and electric connector means mounted on said body and electrically connected to said control circuit unit for external electric connection;

(b) support means for supporting said display units as a matrix of horizontal rows and vertical columns; and (c) said control circuit unit in each of said display units comprising shift registers for shifting pulse-width modulated color signals for display in color tones, latches for latching output signals from said shift registers, and drivers responsive to output signals from said latches for energizing said light-emitting elements, said electric connector means in each of said display units being attached to said rear panel and including a signal inlet for applying said color signals and a shift pulse signal to said shift registers and applying a latch pulse signal to said latches, a signal outlet for delivering out said color signals from said shift registers, said shift pulse signal, and said latch pulse signal, and a power supply inlet for supplying electric power to said control circuit unit, said signal inlets and signal outlets of adjacent display units in each of said horizontal rows being electrically connected, further including a power supply to which said power supply inlets of all of said display units are electrically connected.

8. A color display system according to claim 7, wherein said triads are in the form of regular and inverted regular triangles disposed alternatively along each of said display units, said body having opposite sides inclined with respect to a horizontal plane and substantially parallel to inclination of sides of the triangular triads on each said display unit.

9. A color display system according to claim 7, wherein each of said sockets has a pair of laterally projecting attachment legs, said legs projecting oppositely to one another from an end thereof and defining a direction, said sockets being attached to said body with said direction defined by said attachment legs being inclined at a predetermined angle with respect to the horizontal direction of said triads.

10. A color display system according to claim 7 wherein said body is molded of synthetic resin and has tubular casings constituting outer shells of said sockets, respectively.

11. A color display system according to claim 10, wherein tubular said casings have portions projecting upwardly from an upper surface of said body and portions projecting downwardly from a lower surface of said body.

12. A color display system according to claim 7, wherein said support means comprises vertical posts disposed to bridge across joints between adjacent ones of said display units in said horizontal rows, and support plates fixed to said vertical posts, respectively, said adjacent display units being fixed through said support plates to said vertical posts.

13. A color display system comprising:

(a) a plurality of display units each composed of a body having a front panel and a rear panel, said front panel supporting two rows of sockets thereon, and two rows of light-emitting elements mounted respectively in said sockets and capable of emitting light of three primary colors, said light-emitting elements being grouped into a horizontal array of triads formed of said two rows of light-emitting elements on each of said display units, a control circuit unit housed in each said body for controlling said light-emitting elements, said control circuit unit including a printed-circuit board electrically connected to said sockets, and electric connector means mounted on said body and electrically connected to said control circuit unit for external electric connection;

(b) support means for supporting said display units as a matrix of horizontal rows and vertical columns, said display units being disposed closely in each of the horizontal rows and spaced in each of the vertical columns with passages defined between said display units in each of said vertical columns;

(c) ventilator means disposed behind said display units for forcibly delivering air through said passages; and (d) said control circuit unit in each of said display units comprising shift registers for shifting pulse-width modulated color signals for display in color tones, latches for latching output signals from said shift registers, and drivers responsive to output signals from said latches for energizing said light-emitting elements, said electric connector means in each of said display units being attached to said rear panel and including a signal inlet for applying said color signals and a shift pulse signal to said shift registers and applying a latch pulse signal to said latches, a signal outlet for delivering out said color signals from said shift registers, said shift pulse signal, and said latch pulse signal, and a power supply inlet for supplying electric power to said control circuit unit, said signal inlets and signal outlets of adjacent display units in each of said horizontal rows being electrically connected, further including a power supply to which said power supply inlets of all of said display units are electrically connected.

14. A color display system according to claim 7 or 13, wherein each said body has a pair of rear side recesses, said support means comprising vertical posts disposed behind said display units and held in substantial alignment with joints between adjacent display units in each of said horizontal rows, guides fixed to opposite sides of each of said vertical posts, arms retractably extending through said guides, respectively, and support racks fixed to sides of said arms on ends thereof and disposed in the rear side recess in a selected number of adjacent display units in each of said vertical columns, said support racks supporting rear portions of said selected number of display units, each said display unit being positionable behind the adjacent display units when said arms are retracted.

* * * * *